US008519247B2

(12) United States Patent
Mitchell

(10) Patent No.: US 8,519,247 B2
(45) Date of Patent: Aug. 27, 2013

(54) ROTATABLE COMBINATION GUITAR/BASS GUITAR

(76) Inventor: James L. Mitchell, Romeo, MI (US)

( * ) Notice: Subject to any disclaimer, the term of this patent is extended or adjusted under 35 U.S.C. 154(b) by 308 days.

(21) Appl. No.: 13/081,350

(22) Filed: Apr. 6, 2011

(65) Prior Publication Data

US 2011/0247474 A1 Oct. 13, 2011

Related U.S. Application Data

(60) Provisional application No. 61/321,836, filed on Apr. 7, 2010.

(51) Int. Cl.
*G10D 3/00* (2006.01)

(52) U.S. Cl.
USPC ..... 84/293; 84/267

(58) Field of Classification Search
USPC ..... 84/293, 267, 291
See application file for complete search history.

(56) References Cited

U.S. PATENT DOCUMENTS

| | | | | |
|---|---|---|---|---|
| 1,022,031 | A | 4/1912 | Larson | |
| 3,636,809 | A | 1/1972 | Ezaki | |
| 5,251,526 | A | 10/1993 | Hill | |
| 5,390,578 | A * | 2/1995 | Raymer | 84/291 |
| 7,102,073 | B1 | 9/2006 | Isola | |
| 7,781,654 | B1 * | 8/2010 | Kamensky | 84/267 |
| 7,872,185 | B1 * | 1/2011 | Chadwick | 84/293 |
| 2003/0188622 | A1 * | 10/2003 | Wilson | 84/267 |
| 2003/0217634 | A1 * | 11/2003 | Zigounakis | 84/293 |

* cited by examiner

*Primary Examiner* — Jianchun Qin
(74) *Attorney, Agent, or Firm* — Preston Smirman; Smirman IP Law, PLLC

(57) ABSTRACT

A combination stringed musical instrument, such as a four string electric bass and a six string electric guitar, is described. The combination stringed musical instrument includes a single neck portion with opposed fret boards formed or disposed on either side or major face of the neck portion. Accessibility to either stringed musical instrument may be accomplished by neck portion rotation, relative to the body portion, facilitated by an ergonomically placed and designed handle assembly. User initiated neck portion rotation may be facilitated by an internal shaft and bearing set, interconnecting the neck portion and the body portion. Manipulation of the handle may cause a positive neck portion position placement and neck portion fixation via retention hardware. The combined instrument presents a conventional-appearing electric guitar/bass guitar.

20 Claims, 7 Drawing Sheets

FIG. 4
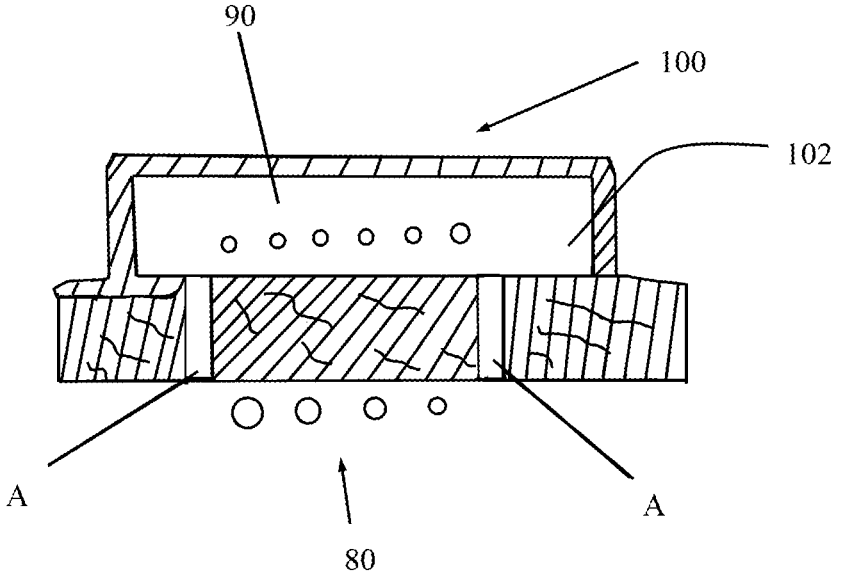
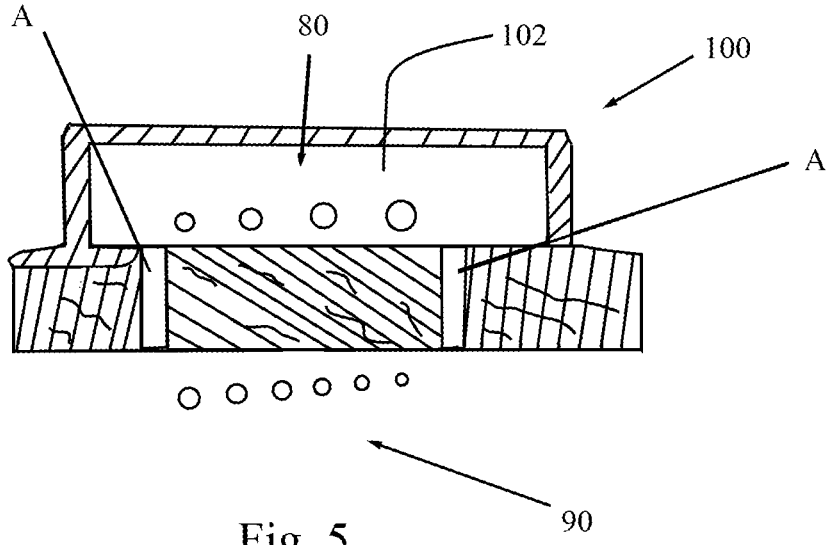
Fig. 5

Fig. 8A
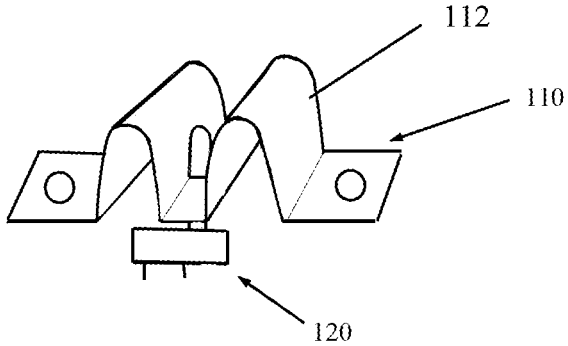
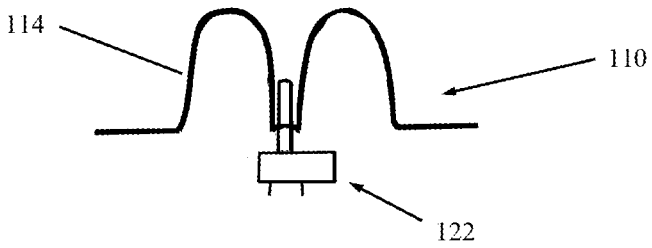
Fig. 8B

ROTATABLE COMBINATION GUITAR/BASS GUITAR

CROSS-REFERENCE TO RELATED APPLICATION

The instant application claims priority to U.S. Provisional Patent Application Ser. No. 61/321,836, filed Apr. 7, 2010, pending, the entire specification of which is expressly incorporated herein by reference.

FIELD OF THE INVENTION

The present invention generally relates to stringed musical instruments and more particularly to stringed musical instruments including a selectively rotatable neck portion including two opposed fret boards with separate stringed musical instruments associated therewith.

BACKGROUND OF THE INVENTION

Designers of stringed musical instruments, especially various types of electric guitars and electric bass guitars, have attempted to achieve a combination stringed musical instrument contained in one usable assembly, i.e., a stringed musical instrument that provides both a guitar and a bass guitar. However, most of these conventional designs have significant disadvantages associated therewith. For example, some designs, such as those depicted in U.S. Pat. No. 1,022,031 to Larson and U.S. Pat. No. 3,636,809 to Ezaki, use separate guitar and bass guitar neck assemblies combined on the same stringed musical instrument body. These designs are thus typically heavier and are less ergonomically playable as compared to their conventional discrete counterparts. U.S. Pat. No. 5,251,526 to Hill depicts opposed instrument fret boards but utilizes an unconventional fret spacing arrangement to create a stringed musical instrument wherein both sides can be played independently or simultaneously through the use of supposedly new, yet undisclosed, chord configurations. This arrangement appears to be quite arduous, coupled with the fact that to present an instrument face for a traditional playing position, the neck must be articulated by removing the strumming hand from the immediate playing area to access a remotely positioned jack box that is attached to a highly unconventional guitar body. U.S. Pat. No. 7,102,073 to Isola depicts discrete, but opposed, separate string musical instruments contained in the same assembly but designed to be played individually with considerable time and effort required to change from one stringed musical instrument to the other.

All of these previously described designs seem cumbersome and unnatural, especially to a trained musician that is accustomed to playing either a conventional electric guitar and/or bass guitar.

Therefore, it would be advantageous to provide a new and improved stringed musical instrument that overcomes at least one of the aforementioned problems.

SUMMARY OF THE INVENTION

In accordance with the general teachings of the present invention, a new and improved stringed musical instrument is provided.

In accordance with one aspect of the present invention, a new and improved electric stringed musical instrument is provided.

In accordance with yet another aspect of the present invention, a new and improved electric stringed musical instrument is provided that includes a single body that provides both an electric bass guitar and an electric guitar function.

In accordance with still yet another aspect of the present invention, a new and improved electric stringed musical instrument is provided that includes a single body that provides both a four string electric bass guitar and a six string electric guitar function.

In this manner, the user may sequentially play an electric bass guitar, and then easily and quickly switch to an electric guitar, and/or vice versa, without having to physically switch between separate guitar/bass guitar bodies.

By way of a non-limiting example, the present invention provides a combination stringed musical instrument such as, but not limited to a four string electric bass guitar and a six string electric guitar, that includes a single neck portion with opposed fret boards (i.e., one fret board providing a four string bass guitar function and a second opposed fret board providing a six string guitar function). Accessibility to either instrument may be accomplished by selective neck portion rotation about a single guitar body that is facilitated by an ergonomically placed and designed handle assembly operably associated with the neck portion. By way of a non-limiting example, user initiated neck portion rotation may be facilitated by an internally located shaft and bearing set operably associated with the guitar body and/or the neck portion. The handle may allow the neck portion to rotate freely about the single guitar body to selectively expose either the bass guitar fret board or the guitar fret board. Manipulation of the handle may cause a positive neck portion position placement and neck portion fixation via retention hardware formed on the body of the stringed instrument. The combined instrument presents a relatively conventional-appearing guitar/bass guitar.

In accordance with a first embodiment of the present invention, a combination stringed musical instrument is provided, comprising: (1) a body portion; and (2) a neck portion selectively rotatable about the body portion, wherein the neck portion is at least partially enveloped by the body portion, wherein the neck portion includes a first major face having a first stringed musical instrument formed thereon, wherein the neck portion includes a spaced and opposed second major face having a second stringed musical instrument formed thereon.

In accordance with a second embodiment of the present invention, a combination stringed musical instrument is provided, comprising: (1) a body portion; and (2) a neck portion selectively rotatable about the body portion, wherein the neck portion includes first and second spaced and opposed major faces, wherein the first and second spaced and opposed major faces of the neck portion are at least partially enveloped by the body portion, wherein the neck portion includes a first major face having a first stringed musical instrument formed thereon, wherein the neck portion includes a spaced and opposed second major face having a second stringed musical instrument formed thereon.

In accordance with a third embodiment of the present invention, a combination stringed musical instrument is provided, comprising: (1) a body portion; (2) a neck portion selectively rotatable about the body portion, wherein the neck portion includes first and second spaced and opposed major faces, wherein the first and second spaced and opposed major faces of the neck portion are at least partially enveloped by the body portion, wherein the neck portion includes a first major face having a first stringed musical instrument formed thereon, wherein the neck portion includes a spaced and opposed second major face having a second stringed musical instrument formed thereon; (3) a headstock portion formed on an end portion of the neck portion; (4) a first tuning peg system formed on a first portion of the headstock portion, wherein the first tuning peg system is operably associated with the first stringed musical instrument; and (5) a second tuning peg system formed on a second portion of the headstock portion, wherein the second tuning peg system is operably associated with the second stringed musical instrument, wherein the first stringed musical instrument or the second stringed musical instrument is selected from the group consisting of a four string bass guitar, a five string bass guitar, a six string bass guitar, a six string guitar, a twelve string guitar, a mandolin, a ukulele, a banjo, a lute, an oud, a sitar, and combinations thereof.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Other advantages of the present invention will be readily appreciated as the same becomes better understood by reference to the following detailed description when considered in connection with the accompanying drawings wherein:

FIG. 4 is a sectional view taken along line 4-4 of FIG. 3, in accordance with a fourth embodiment of the present invention;

FIG. 5 is a sectional view similar to FIG. 4, wherein the neck portion has been rotated relative to the body portion of the stringed musical instrument, in accordance with a fifth embodiment of the present invention;

FIG. 8A is a schematic perspective view of a retention system for selective securing of the neck portion relative to the body of the stringed musical instrument, and a switch system for selectively controlling the sound output of the stringed musical instrument, in accordance with an eighth embodiment of the present invention; and FIG. 8B is a schematic sectional view of a retention system for selective securing of the neck portion relative to the body of the stringed musical instrument, and a switch system for selectively controlling the sound output of the stringed musical instrument, in accordance with a ninth embodiment of the present invention.

The same reference numerals refer to the same parts throughout the various Figures.

DETAILED DESCRIPTION OF THE INVENTION

The following description of the preferred embodiment(s) is merely exemplary in nature and is in no way intended to limit the invention, or uses.

Although the following description of the present invention will be made with primary reference to electric stringed musical instruments, it should be appreciated that the present invention may also be practiced with acoustic stringed musical instruments as well.

Figure 1:
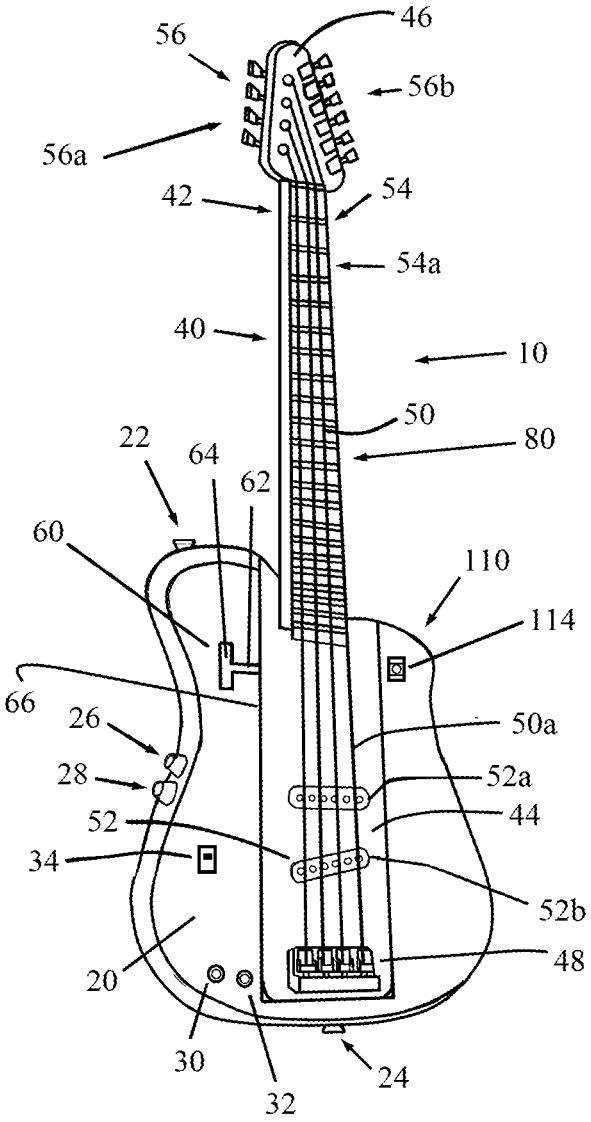
FIG. 1 is a front schematic view of a stringed musical instrument with a four string bass guitar fret board in the playing position, in accordance with a first embodiment of the present invention.
Figure 2:
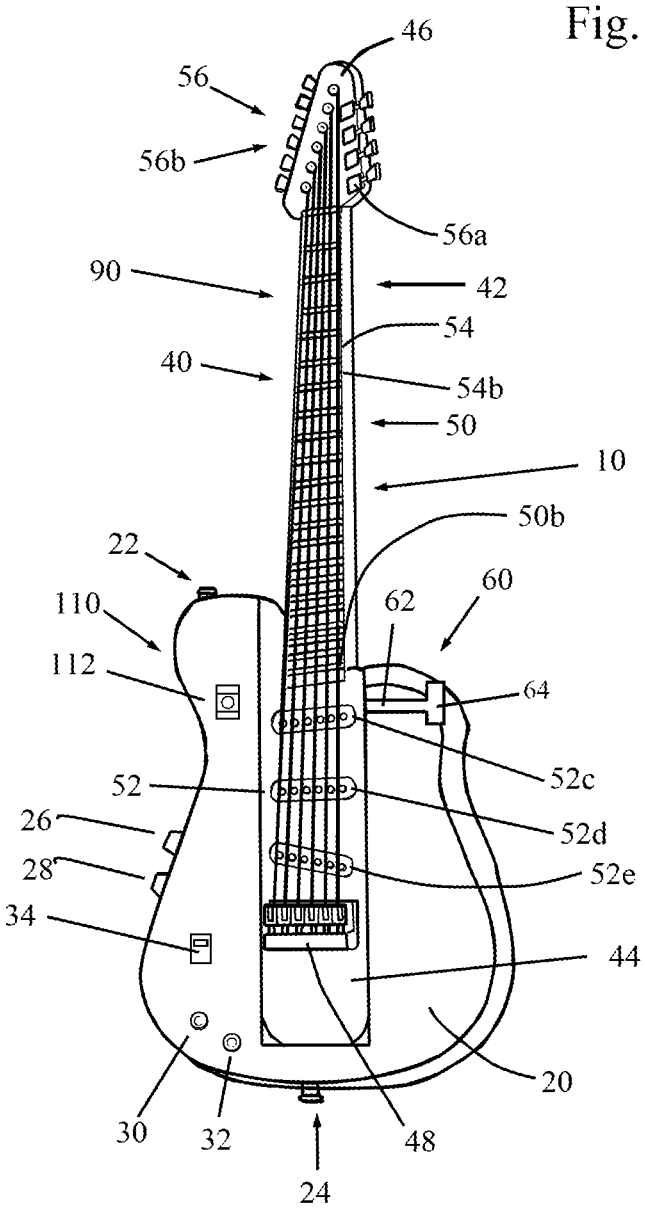
FIG. 2 is a front schematic view of a stringed musical instrument with a six string guitar fret board in the playing position, in accordance with a second embodiment of the present invention.
Figure 7:
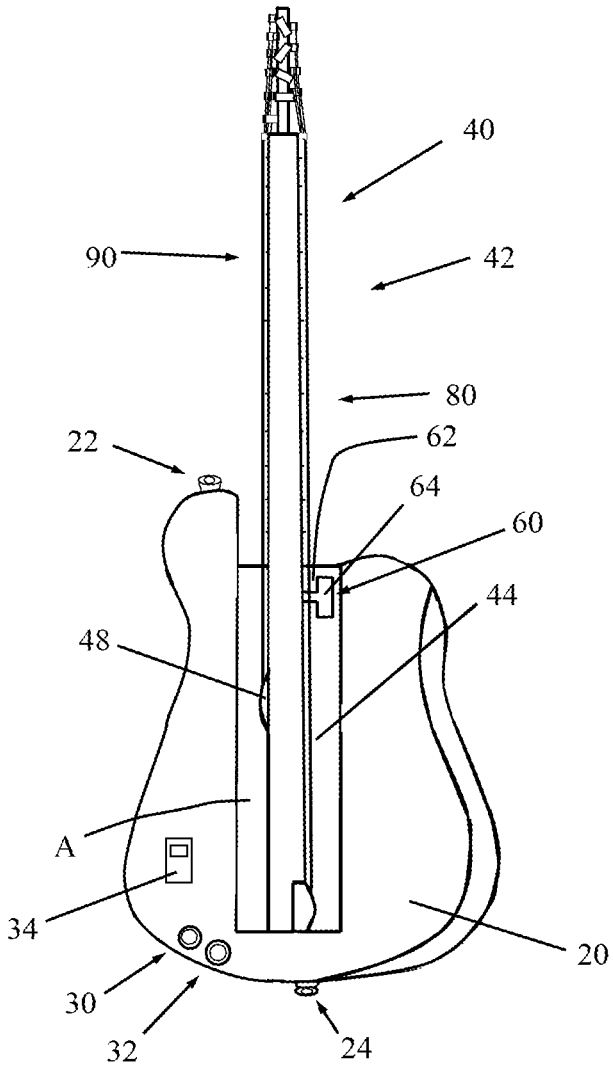
FIG. 7 is a schematic view of the neck portion rotated into an intermediate position relative to the body of the stringed musical instrument, in accordance with a seventh embodiment of the present invention.

Referring to the Figures generally, and specifically to FIGS. 1-2 and 7, there is shown a stringed musical instrument generally at 10, in accordance with the general teachings of the present invention.

The two primary components of the stringed musical instrument 10 are the body portion 20 and the neck portion 40.

The body portion 20 may be shaped in a conventional guitar or bass guitar form, e.g., in this view the body portion 20 includes several moderately curved peripheral surfaces. It should be appreciated that the body portion 20 may includes other shapes and forms, such as but not limited to ovals, circles, rectangles, squares, chevrons (e.g., "flying V's") and/or the like. The materials comprising the body portion 20 are not thought to be critical to the present invention, and may be manufactured of various materials, such as but not limited to metal, plastic, wood, composite, and/or combinations thereof.

As with conventional guitar bodies, the body portion 20 may include two strap connection members 22, 24, respectively, formed on the top front and/or rear bottom portions thereof. Additionally, the body portion 20 may be provided with tone and volume controls 26, 28, respectively, for permitting the sound output to be controlled in terms of loudness and timbre. Also, the body portion 20 may be provided with a bass guitar output jack 30 (e.g., a ¼ phonographic output jack) and a guitar output jack 32 (e.g., a ¼ phonographic output jack) for permitting the sound output of either the bass guitar or the guitar, as the case may be. Optionally, the body portion 20 may also be provided with a selector switch 34 that may control the function of the bass guitar output jack 30 and/or the guitar output jack 32 for permitting the sound output of either the bass guitar or the guitar, as the case may be, e.g., through one or more amplifiers.

The neck portion 40 may be shaped in a conventional guitar or bass guitar form, e.g., in this view the neck portion 40 may be generally rectangular and elongated. The materials comprising the neck portion 40 are not thought to be critical to the present invention, and may be manufactured of various materials, such as but not limited to metal, plastic, wood, composite, and/or combinations thereof.

In this view, the neck portion 40 includes a neck member 42 and a body member 44. The neck member 42 includes a headstock portion 46 formed on an end portion thereof. The body member 44 includes a bridge portion 48 through which string members 50 are placed. Referring specifically to FIG. 1, there is shown an arrangement with a set 50*a* of four string members; however, either less than or more than this number of string members may be employed. Referring specifically to FIG. 2, there is shown an arrangement with a set 50*b* of six string members; however, either less than or more than this number of string members may be employed.

Additionally, the body member 44 includes at least one magnetic pickup member 52 placed thereon. Referring specifically to FIG. 1, there is shown an arrangement with two magnetic pickup members 52*a*, 52*b*, respectively; however, either less than or more than this number of magnetic pickup members may be employed. Referring specifically to FIG. 2, there is shown an arrangement with three magnetic pickup members 52*c*, 52*d*, 52*e*, respectively; however, either less than or more than this number of magnetic pickup members may be employed.

The neck member 42 includes a fret board 54 formed or disposed thereon. Referring specifically to FIG. 1, there is shown a bass guitar fret board 54*a* formed or disposed on a first major face of the neck member 42. Referring specifically to FIG. 2, there is shown a guitar fret board 54*b* formed or disposed on a second opposed major face of the neck member 42. By way of a non-limiting example, the respective fret boards may provide scale lengths such as, but not limited to 34 inches, 32.5 inches, and 30 inches for an electric bass guitar and 25.5 inches, 24.75, and 23.5 inches for an electric guitar.

On the headstock portion 46 there may be provided a set of tuning pegs 56. Referring specifically to FIG. 1, there is shown a set of four tuning pegs 56*a* for a bass guitar. Referring specifically to FIG. 2, there is shown a set of six tuning pegs 56*b* for a guitar. In this manner, both sets of tuning pegs, 56*a*, 56*b*, respectively, are mounted on the same headstock portion 46, albeit on opposed surfaces thereof, thus allowing the player to be able to easily and quickly tune either stringed musical instrument.

The string members 50 extend from the bridge portion 48, over the respective magnetic pickup member(s) 52, over the respective fret board 54, and terminate at the respective set of tuning pegs 56. Thus, the afore-mentioned arrangement may be very similar in appearance, as well as function, to that of a conventional bass guitar or guitar.

However, one of the features of the present invention includes the ability of the player to selectively rotate the neck portion 40, relative to the body portion 20, so as to easily and quickly expose either the bass guitar fret board 54*a* (e.g., to provide a bass guitar function) or the guitar fret board 54*b* (e.g., to provide a guitar function). To permit this, an area defining an aperture A may be formed in the body portion 20 so as to permit the neck portion 40, and more specifically the body member 44, to rotate, e.g., 180 degrees, about the aperture A.

Referring specifically to FIGS. 1-2 and 6-7, an ergonomically designed and located handle system 60 may be provided in operable association with the neck portion 40. By way of a non-limiting example, the handle system 60 includes a shaft member 62 connected to the neck portion 40, and a handle member 64 connected to the shaft member 62. Although the handle system 60 may be mounted in various locations, and made by various methodologies, a preferred embodiment may be to adhesively bond the shaft member 62 into a slot 66 formed on the body member 44 approximately located just past the end of the fret board 54 to permit swift accessibility from the playing area. The materials comprising the handle system 60 are not thought to be critical to the present invention, and may be manufactured of various materials, such as but not limited to metal, plastic, wood, composite, and/or combinations thereof. Furthermore, the exact shape of the handle member 64 is not thought to be critical to the present invention, provided that it may be easily grasped and manipulated by the player. By way of a non-limiting example, the handle member 64 may have a curved shape for easy finger engagement for an upward motion and a ribbed top for positive palm hand grip in a downward motion.

In order to permit the neck portion 40 to rotate relative to the body portion 20, a rotation system 70 may be provided. By way of a non-limiting example, the rotation system 70 includes a shaft member 72 that may be rotatably received in one or more roller bearings 74, 76, respectively. The shaft member 72 and roller bearings 74, 76, respectively, may be located within an internal cavity formed in either the neck member 42 and/or the body member 44, thus interconnecting the two components. The body member 44 may rotate with relative minimal effort and very low frictional opposition because of the embedded roller bearings 74, 76, respectively. By way of a non-limiting example, the shaft member 72 may be adhesively bonded to the body member 44 (e.g., preferably in the center of the body member 44) and the roller bearings 74, 76, respectively, may be press fitted in the body member 44, thus allowing the body member 44, e.g., via the roller bearings 74, 76, respectively, to rotate about the shaft member 72. The materials comprising the rotation system 70 are not thought to be critical to the present invention, and may be manufactured of various materials, such as but not limited to metal, plastic, wood, composite, and/or combinations thereof. By way of a non-limiting example, shaft member 72, and the roller bearings 74, 76, respectively, are comprised of stainless steel.

Thus, in practice, when the player wishes to switch from a bass guitar function to a guitar function, or vice versa, the player merely grasps the handle member 64 and rotates it either in a downwardly or an upwardly manner (depending on which function is desired) so as to either expose the bass guitar portion 80 of the neck portion 40 or the guitar portion 90 of the neck portion 40. In this manner, the rotational motion allows relatively seamless play from one particular fret board (i.e., either that of the bass guitar to that of the guitar or vice versa) to the other during the performance of a given musical piece.

Referring specifically to FIG. 7, the neck portion 40 is shown in an intermediate position, i.e., between the bass guitar portion 80 of the neck portion 40 and the guitar portion 90 of the neck portion 40. In this particular view, the aperture A is very clearly shown.

Figure 3:
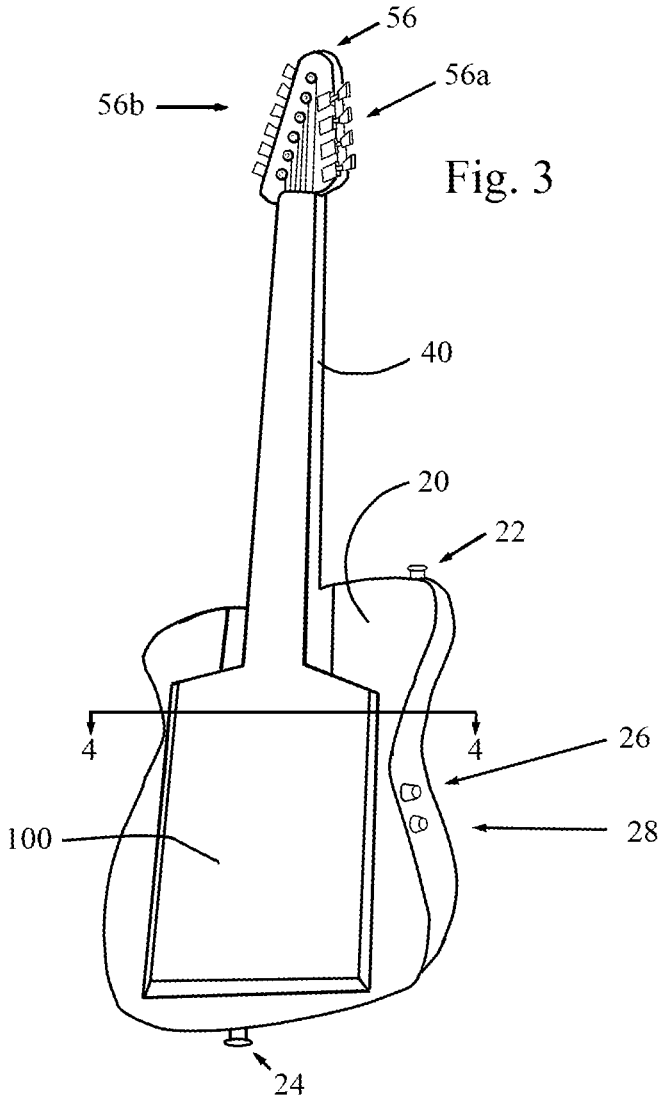
FIG. 3 is a rear schematic view of a stringed musical instrument with a shroud member covering the non-playable fret board, in accordance with a third embodiment of the present invention.
Figure 6:
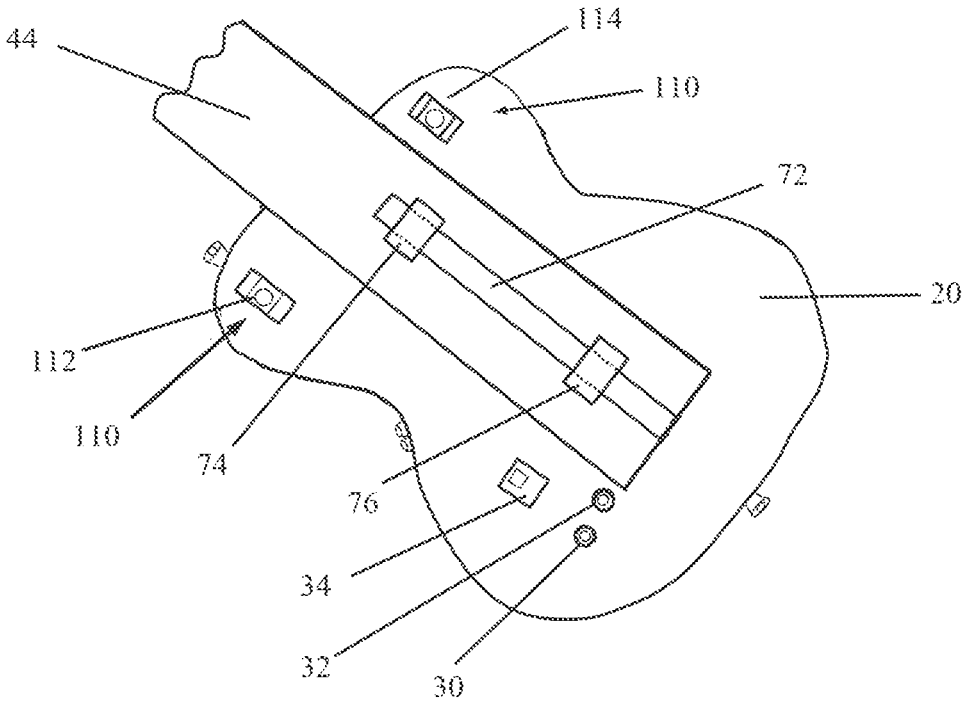
FIG. 6 is a partial schematic view of a rotation system for selective rotation of the neck portion relative to the body of the stringed musical instrument, in accordance with a sixth embodiment of the present invention.

Referring specifically to FIGS. 3-5, in order to prevent the player from inadvertently contacting the bass guitar portion 80 when the guitar portion 90 is exposed and being played, or conversely, inadvertently contacting the guitar portion 90 when the bass guitar portion 80 is exposed and being played, a shroud member 100 may be provided. The shroud member 100 may be intended to provide a physical barrier so that the player's torso or abdomen cannot come into physical contact with at least a portion of the non-played portion of the neck portion 40. The shroud member 100 provides a generally "C" or "U" shaped body recess to cover the aperture A while simultaneously permitting the rotation of the neck portion 40, more specifically the body member 44. The shroud member 100 may be adhesively bonded to the rear surface of the body portion 20, thus enclosing the rearward facing string surfaces from the player and providing a conventional appearing neck and body presentation. The shroud member 100 may also provide structural rigidity to the stringed musical instrument 10.

It should be appreciated that the shroud member 100 should provide a sufficient amount of clearance space 102 such that the neck portion 40, specifically the body member 44, may freely rotate about the body portion 20 without striking the shroud member 100 or being impeded thereby. The materials comprising the shroud member 100 are not thought to be critical to the present invention, and may be manufactured of various materials, such as but not limited to metal, plastic, wood, composite, and/or combinations thereof. By way of a non-limiting example, the shroud member 100 may be comprised of composite materials, such as but not limited to fiberglass, carbon fiber, and/or the like.

It should also be noted that the body member 44 may be substantially enveloped on at least two sides or major surfaces/faces (e.g., top and bottom surfaces thereof) by the body portion 20, thus giving the stringed musical instrument 10 a relatively conventional guitar-like appearance. Also, the front surface of the body member 44 may be substantially coplanar to the front surface of the body portion 20, again giving the stringed musical instrument 10 a relatively conventional guitar-like appearance.

Referring specifically to FIGS. 1-2, 6 and 8A-8B, in order to hold the body member 44 in precise playing position, a retention system 110 may be provided. By way of a non-limiting example, spaced and opposed retention clip members 112, 114, respectively, may be provided on the front surface of the body portion 20. These retention clip members 112, 114, respectively, may be of the low frictional force variety such that they are able to securely engage the shaft member 62, but not to the extent that a significant amount of force would need to be applied to dislodge the shaft member 62 therefrom. By way of a non-limiting example, the clip members 112, 114, respectively, may frictionally engage the shaft member 62 in an interference fit.

The materials comprising the retention clip members 112, 114, respectively, are not thought to be critical to the present invention, and may be manufactured of various materials, such as but not limited to metal, plastic, wood, composite, and/or combinations thereof. By way of a non-limiting example, the retention clip members 112, 114, respectively, may be comprised of steel, e.g., spring steel.

By way of a non-limited example, the retention clip members 112, 114, respectively, may be formed from spring steel tangs (e.g., of a shape as shown in FIGS. 8A and 8B) that are screw mounted or otherwise fastened to the front surface of the body portion 20. As previously described, activation of the handle member 64 causes an approximate 180 degree neck portion 40 rotation of the fret board member 54 from a primary playing position to a secondary playing position (the use of the terms "primary" and "secondary" are for reference purposes only). For example, the shaft member 62 may be held in the primary position by retention clip member 112 and the secondary position by retention clip member 114. Because the handle member 64 may be close to an ergonomic location relative to the picked or strummed playing area, the respective fret boards (which are opposed to one another) may be put seamlessly into playing position (and out again) such that both playing surfaces have excellent accessibility and may be played in alternate combinations in a limitless fashion for any given musical piece.

Referring specifically to FIGS. 8A-8B, when in the non-playable position, the non-played instrument's magnetic pickup members 52 (e.g., see FIGS. 1-2) are electrically decoupled from the active circuit whereas the active playing instrument has its signal available for output through output jacks 30, 32 respectively, via a traditional bass guitar amplifier and/or guitar amplifier, as the case may be. The change in electrical selectivity may be accomplished in multiple ways but a preferred method may be to provide positional proximity switches 120, 122, respectively, (e.g., one each operably associated with the retention clip members 112, 114, respectively) that may be activated by contact with the handle member 62. By way of a non-limiting example, the signal may be routed out to selector switch 34, thus allowing both stringed musical instruments to play through instrument specific output jacks 30, 32, respectively, or in a combined manner through either output jack 30 or output jack 32, thus facilitating connection to one or more traditional amplifier(s), as desired. The routing of the pickup wires is best accomplished out the body member 44 to the body portion 20 with sufficient length wire leads so as to accommodate neck to body rotation without compromising the circuit connection.

Although the above description has been directed primarily to the combination of a four string bass guitar and a six string guitar configuration, it should be appreciated that any number of combinations of stringed musical instruments (e.g., those having a plurality of strings associated therewith) may be employed in conjunction with the present invention. By way of a non-limiting example, other combinations that may be employed may include any of the following stringed musical instruments: four string bass guitar; five string bass guitar; six string bass guitar; six string guitar; twelve string guitar; mandolin; ukulele; banjo; lute; oud; sitar; and combinations thereof.

While the invention has been described with reference to an exemplary embodiment, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A combination stringed musical instrument, comprising:
- a body portion; and
- a neck portion selectively rotatable to rotate 180 degrees about the body portion;
- wherein the neck portion is at least partially enveloped by the body portion;
- wherein the neck portion includes a first major face having a first stringed musical instrument formed thereon;
- wherein the neck portion includes a spaced and opposed second major face having a second stringed musical instrument formed thereon;
- wherein either the first stringed musical instrument or the second stringed musical instrument is in a playing position when the neck portion is rotated.

2. The combination stringed musical instrument according to claim 1, wherein the neck portion includes first and second spaced and opposed major faces, wherein the first and second spaced and opposed major faces of the neck portion are at least partially enveloped by the body portion.

3. The combination stringed musical instrument according to claim 1, further comprising:
- a headstock portion formed on an end portion of the neck portion;
- a first tuning peg system formed on a first portion of the headstock portion, wherein the first tuning peg system is operably associated with the first stringed musical instrument; and
- a second tuning peg system formed on a second portion of the headstock portion, wherein the second tuning peg system is operably associated with the second stringed musical instrument.

4. The combination stringed musical instrument according to claim 1, wherein the body portion includes an area defining an aperture formed therein; wherein the neck portion is selectively rotatable to rotate 180 degrees within the aperture.

5. The combination stringed musical instrument according to claim 1, further comprising a shroud member formed on a rear surface of the body portion, wherein the body portion includes an area defining an aperture formed therein, wherein the shroud member is selectively operable to cover the aperture.

6. The combination stringed musical instrument according to claim 1, further comprising a shroud member formed on a rear surface of the body portion, wherein the shroud member is selectively operable to block access to the first stringed musical instrument or the second stringed musical instrument.

7. The combination stringed musical instrument according to claim 1, further comprising a rotation system operably associated with either the neck portion or the body portion for permitting the neck portion to rotate about the body portion.

8. The combination stringed musical instrument according to claim 1, further comprising a handle system operably associated with the neck portion for permitting the neck portion to rotate about the body portion.

9. The combination stringed musical instrument according to claim 1, further comprising an electronic control system operably associated with the body portion for permitting sound output from the first stringed musical instrument while simultaneously blocking sound output from the second stringed musical instrument.

10. The combination stringed musical instrument according to claim 1, wherein the first stringed musical instrument or the second stringed musical instrument is selected from the group consisting of a four string bass guitar, a five string bass guitar, a six string bass guitar, a six string guitar, a twelve string guitar, a mandolin, a ukulele, a banjo, a lute, an oud, a sitar, and combinations thereof.

11. A combination stringed musical instrument, comprising:

a body portion; and a neck portion selectively rotatable to rotate 180 degrees about the body portion;

wherein the neck portion includes first and second spaced and opposed major faces;

wherein the first and second spaced and opposed major faces of the neck portion are at least partially enveloped by the body portion;

wherein the neck portion includes a first major face having a first stringed musical instrument formed thereon;

wherein the neck portion includes a spaced and opposed second major face having a second stringed musical instrument formed thereon;

wherein either the first stringed musical instrument or the second stringed musical instrument is in a playing position when the neck portion is rotated.

12. The combination stringed musical instrument according to claim 11, further comprising:

a headstock portion formed on an end portion of the neck portion;

a first tuning peg system formed on a first portion of the headstock portion, wherein the first tuning peg system is operably associated with the first stringed musical instrument; and a second tuning peg system formed on a second portion of the headstock portion, wherein the second tuning peg system is operably associated with the second stringed musical instrument.

13. The combination stringed musical instrument according to claim 11, wherein the body portion includes an area defining an aperture formed therein; wherein the neck portion is selectively rotatable to rotate 180 degrees within the aperture.

14. The combination stringed musical instrument according to claim 11, further comprising a shroud member formed on a rear surface of the body portion, wherein the body portion includes an area defining an aperture formed therein, wherein the shroud member is selectively operable to cover the aperture and block access to the first stringed musical instrument or the second stringed musical instrument.

15. The combination stringed musical instrument according to claim 11, further comprising a rotation system operably associated with either the neck portion or the body portion for permitting the neck portion to rotate about the body portion.

16. The combination stringed musical instrument according to claim 11, further comprising a handle system operably associated with the neck portion for permitting the neck portion to rotate about the body portion.

17. The combination stringed musical instrument according to claim 11, further comprising an electronic control system operably associated with the body portion for permitting sound output from the first stringed musical instrument while simultaneously blocking sound output from the second stringed musical instrument.

18. The combination stringed musical instrument according to claim 11, wherein the first stringed musical instrument or the second stringed musical instrument is selected from the group consisting of a four string bass guitar, a five string bass guitar, a six string bass guitar, a six string guitar, a twelve string guitar, a mandolin, a ukulele, a banjo, a lute, an oud, a sitar, and combinations thereof.

19. A combination stringed musical instrument, comprising:

a body portion;

a neck portion selectively rotatable to rotate 180 degrees about the body portion;

wherein the neck portion includes first and second spaced and opposed major faces;

wherein the first and second spaced and opposed major faces of the neck portion are at least partially enveloped by the body portion;

wherein the neck portion includes a first major face having a first stringed musical instrument formed thereon;

wherein the neck portion includes a spaced and opposed second major face having a second stringed musical instrument formed thereon;

wherein either the first stringed musical instrument or the second stringed musical instrument is in a playing position when the neck portion is rotated;

a headstock portion formed on an end portion of the neck portion;

a first tuning peg system formed on a first portion of the headstock portion, wherein the first tuning peg system is operably associated with the first stringed musical instrument; and a second tuning peg system formed on a second portion of the headstock portion, wherein the second tuning peg system is operably associated with the second stringed musical instrument;

wherein the first stringed musical instrument or the second stringed musical instrument is selected from the group consisting of a four string bass guitar, a five string bass guitar, a six string bass guitar, a six string guitar, a twelve string guitar, a mandolin, a ukulele, a banjo, a lute, an oud, a sitar, and combinations thereof.

20. The combination stringed musical instrument according to claim 19, further comprising a shroud member formed on a rear surface of the body portion, wherein the body portion includes an area defining an aperture formed therein, wherein the neck portion is selectively rotatable to rotate 180 degrees within the aperture, wherein the shroud member is selectively operable to cover the aperture and block access to the first stringed musical instrument or the second stringed musical instrument.

* * * * *